US005848875A

United States Patent [19]

San-Jou

[11] Patent Number: 5,848,875

[45] Date of Patent: Dec. 15, 1998

[54] COMBINATIONAL AIR BLOWER AND EXHAUSTER

[76] Inventor: Wen San-Jou, P.O. Box 82-144, Taipei City, Taiwan

[21] Appl. No.: 810,364

[22] Filed: Mar. 3, 1997

[51] Int. Cl.[6] ..... F04D 3/00

[52] U.S. Cl. ..... 415/220; 415/182.1; 415/214.1; 417/423.1

[58] Field of Search ..... 415/182.1, 214.1, 415/220, 121.3, 151, 156, 157; 417/234, 423.14, 423.1, 360; 251/149.6, 149.1

[56] References Cited

U.S. PATENT DOCUMENTS 4,394,784 7/1983 Swenson et al. ..... 5/453

4,678,014 7/1987 Owen et al. ..... 141/67

5,606,756 3/1997 Price ..... 5/713

*Primary Examiner*—Edward K. Look

*Assistant Examiner*—Richard Woo

*Attorney, Agent, or Firm*—A & J

[57] ABSTRACT

A combinational air blower and exhauster includes a case including a blowing chamber and an exhausting chamber engaged with the blowing chamber, the blowing and exhausting chambers being each provided with a spring-loaded pin at the central portion of an outer end thereof, and an impeller disposed within the case, whereby the combinational air blower and exhauster can be conveniently used as an air blower or exhauster as required.

1 Claim, 14 Drawing Sheets

COMBINATIONAL AIR BLOWER AND EXHAUSTER

BACKGROUND OF THE INVENTION

1. Field of the Invention

This invention is related to a combinational air blower and exhauster.

2. Description of the Prior Art

It has been found that the conventional inflatable rubber article as shown in FIG. 11 must be blown by mouth thereby causing much inconvenience in use. Hence, a nozzle connector 4 (see FIGS. 12 and 13) provided with a check valve 5 has been proposed to fit in the inflatable rubber article to obviate this drawback. However, a blower must be used in order to blow air through the nozzle connector 4 into the inflatable rubber article. The blower includes a case 1, an impeller 2, a locking member 3, and a battery cover 43 with a protuberance 44 adapted to push open the check valve 5 of the nozzle connector 4. Nevertheless, such a blower cannot be used for exhausting air from the inflatable rubber article and it is necessary to open the cover 32 of the nozzle connector in order to exhaust air from the inflatable article (see FIG. 14). However, it is impossible to exhaust all air from the inflatable rubber article thereby causing much inconvenience in use.

Therefore, it is an object of the present invention to provide an combinational air blower and exhauster which can obviate and mitigate the above-mentioned drawbacks.

SUMMARY OF THE INVENTION

This invention is related to a combinational air blower and exhauster.

It is the primary object of the present invention to provide a combinational air blower and exhauster which can be used to blow up or exhaust an inflatable rubber article.

It is another object of the present invention to provide a combinational air blower and exhauster which blows air at an end and exhaust air at the other.

It is still another object of the present invention to provide a combinational air blower and exhauster which is simple in construction.

It is still another object of the present invention to provide a combinational air blower and exhauster which is easy to manufacture.

It is a further object of the present invention to provide a combinational air blower and exhauster which is fit for practical use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numbers refer to identical or similar parts.

DETAILED DESCRIPTION OF THE PREFERRED EMBODIMENT

Figure 1:
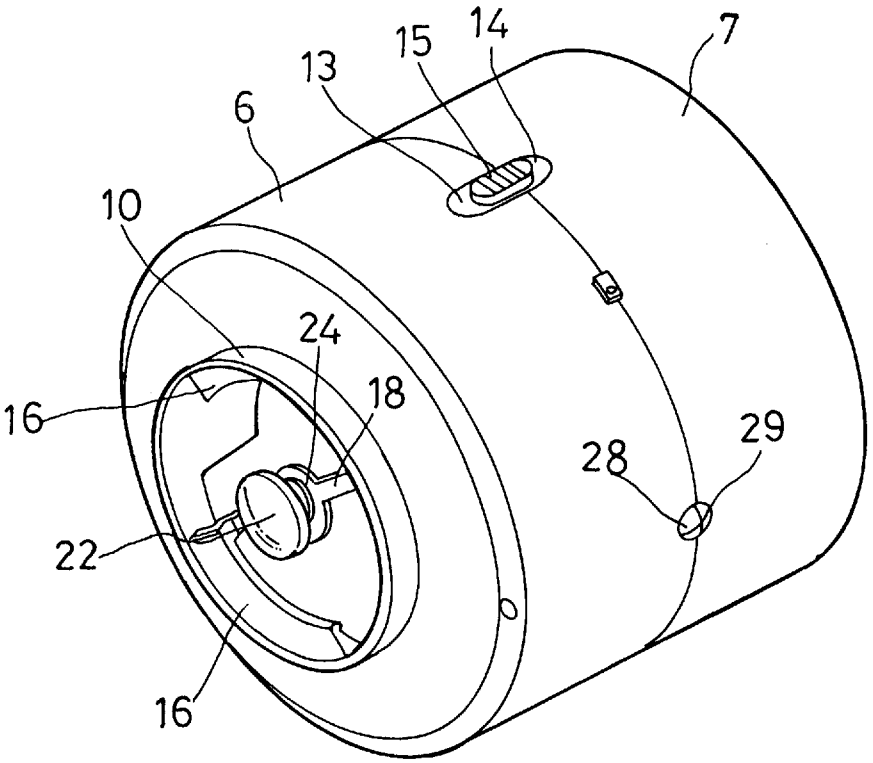
FIG. 1 is a perspective view of the present invention.
Figure 2:
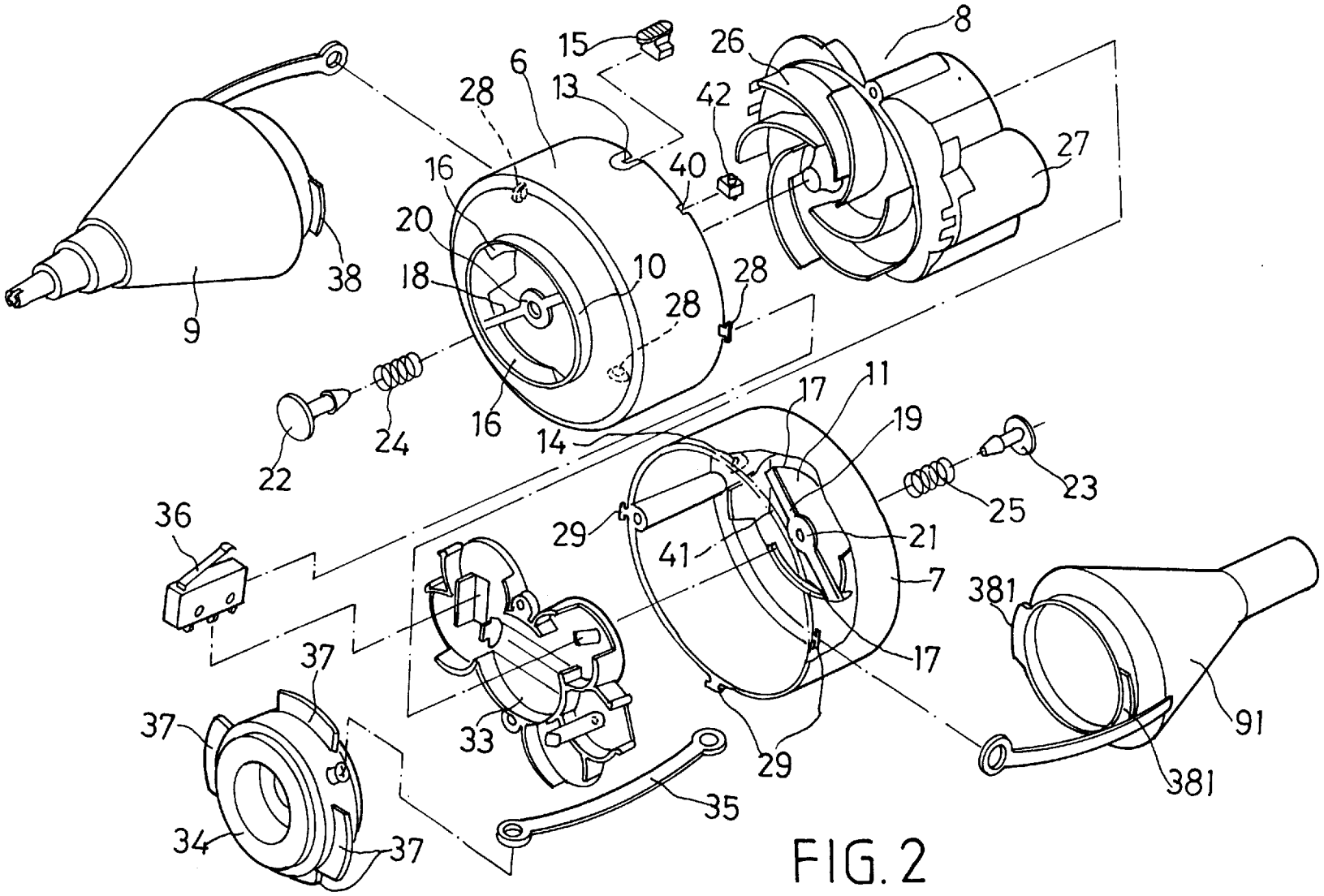
FIG. 2 is an exploded view of the present invention.
Figure 3:
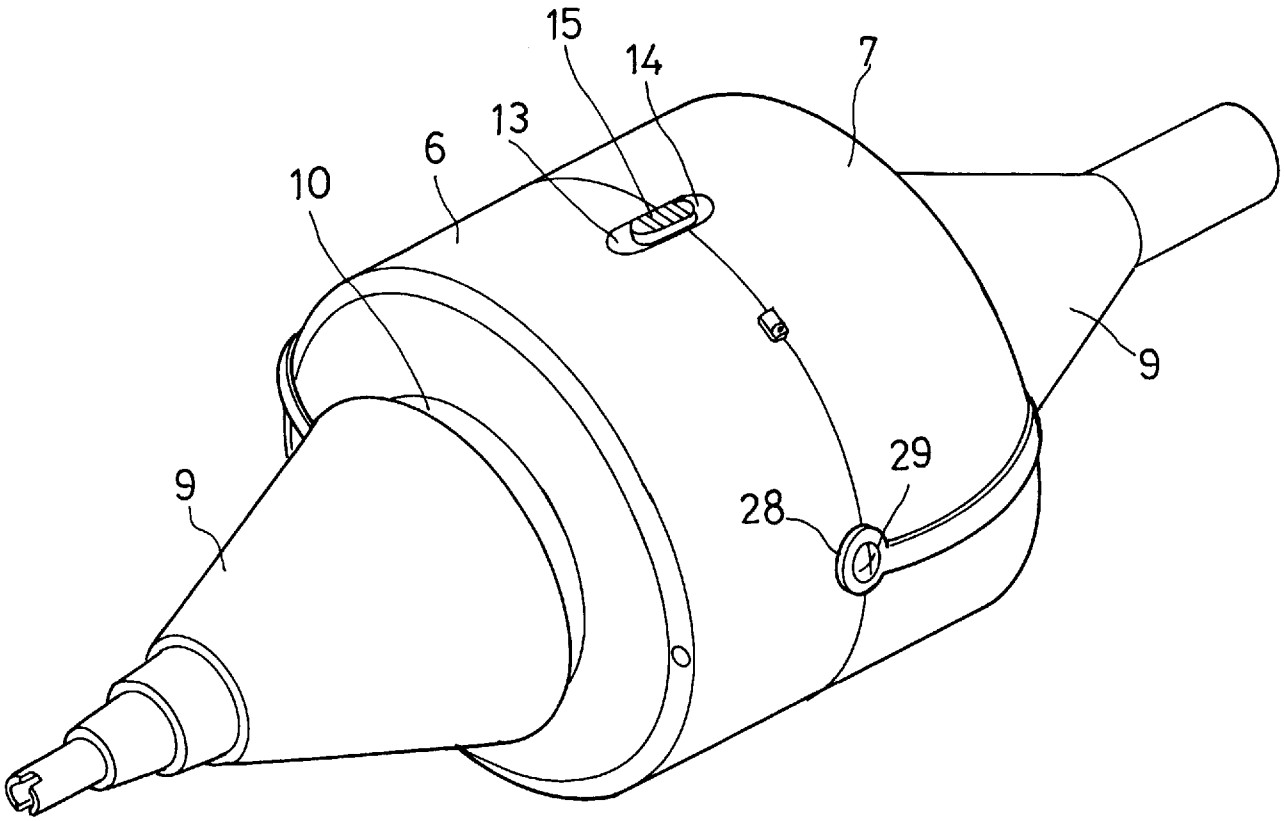
FIG. 3 is a perspective view of the present invention engaged with blowing and exhausting hoods.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to the drawings and in particular to FIGS. 1, 2, 3, 4 and 5 thereof, the combinational air blower and exhauster according to the present invention mainly comprises a blowing chamber 6, an exhausting chamber 7, an impeller 8, a blowing hood 9, an exhausting hood 91, a connecting member 34, and a cover 33.

The blowing chamber 6 is a cylindrical case and has the same structure as the exhausting chamber 7. The blowing chamber 6 is engaged with the exhaust chamber 7 to form a case. The blowing and exhausting chambers 6 and 7 are formed at the circumferential edge of their one ends with opposite slots 13 and 14, notches 40 and 41, and a plurality of semi-circular hooks 28 and 29, respectively. The other ends of the blowing and exhausting chambers 6 and 7 are formed with neck portions 10 and 11, respectively. The neck portion 10 is provided with a pair of lugs 16, while the neck portion 11 with a pair of lugs 17. Between the two lugs 16 there is a rib 18 having a center hole 20 at the intermediate portion. Also, a rib 19 is provided between the two lugs 17 and has a center hole 21 at the intermediate portion. A first pin 22 enclosed with a spring 24 is inserted into the center hole 20 of the rib 19 and a second pin 23 enclosed with a spring 25 is fitted in the center hole 21 of the rib 19, so that the pins 22 and 23 tend to go outwardly from the ribs 18 and 19, respectively.

Figure 10:
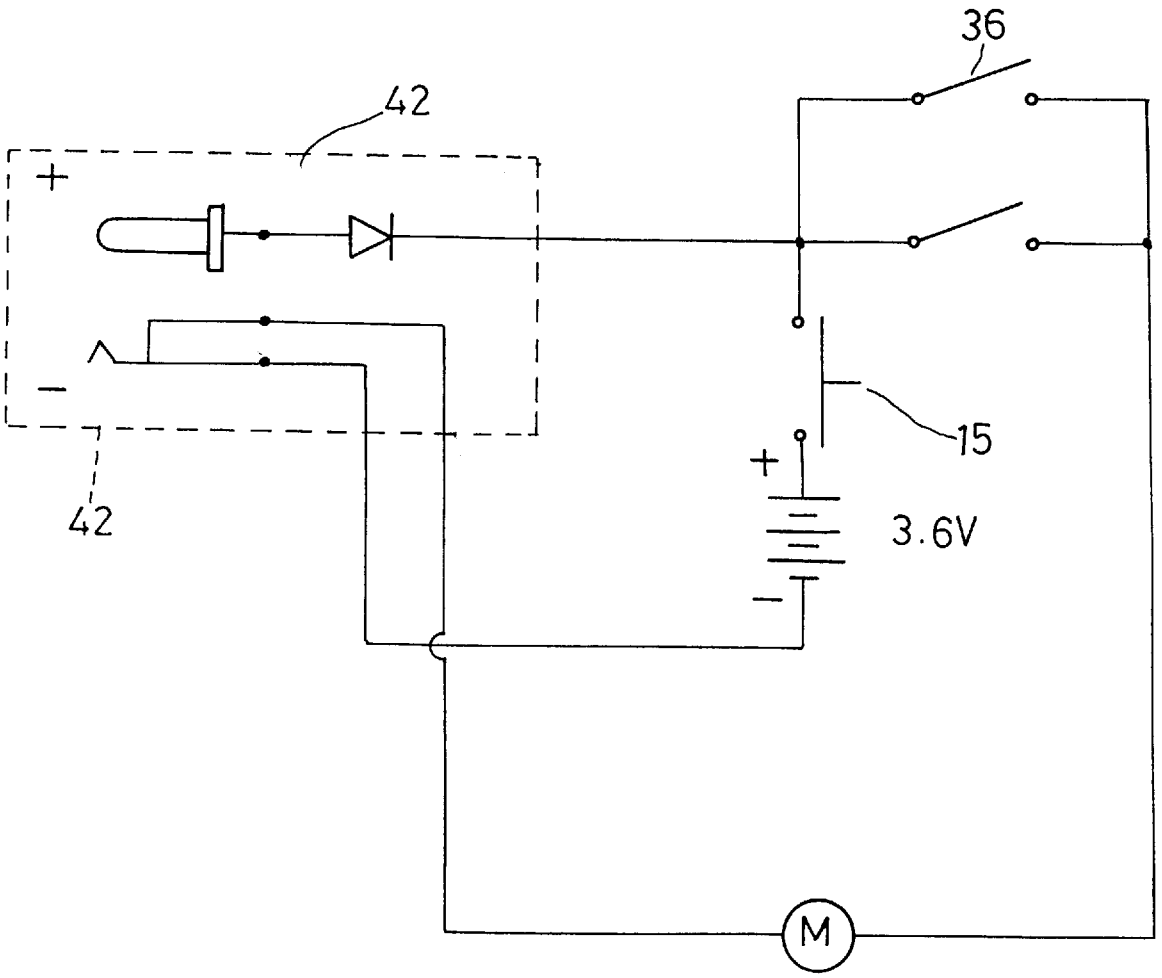
FIG. 10 is a circuit diagram of the present invention.
Figure 11:
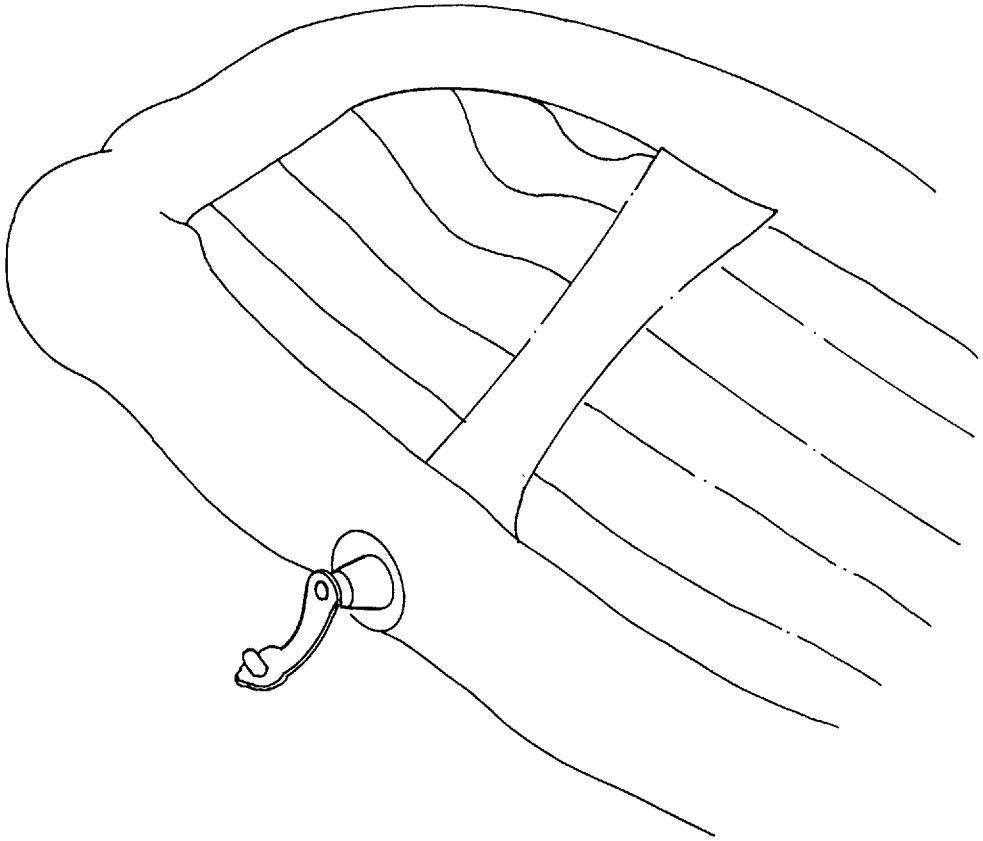
PRIOR ART FIG.11
FIG. 11 is a perspective view of a prior art inflatable article.
Figure 12:
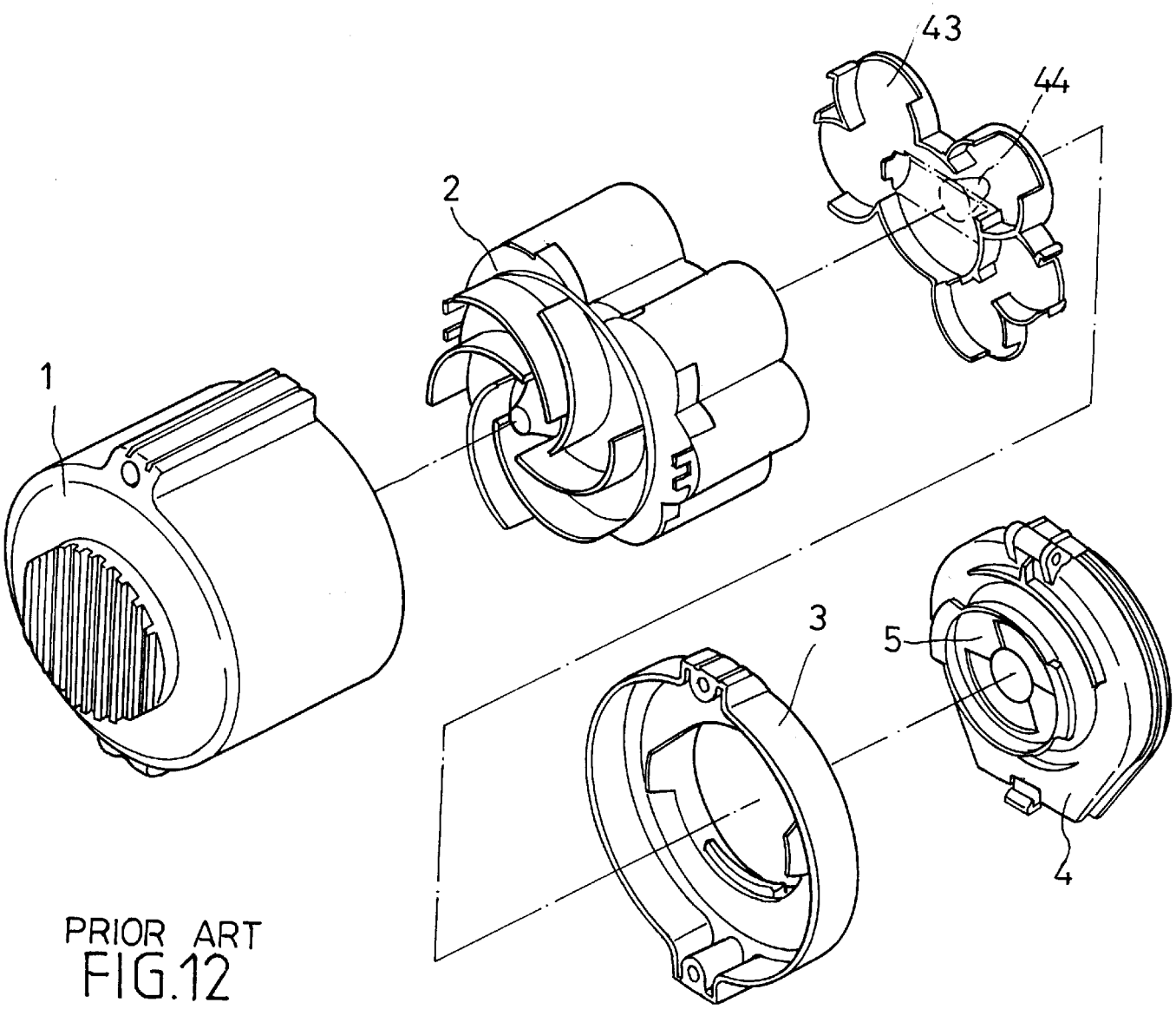
PRIOR ART FIG.12
FIG. 12 illustrates a prior art air blower.
Figure 13:
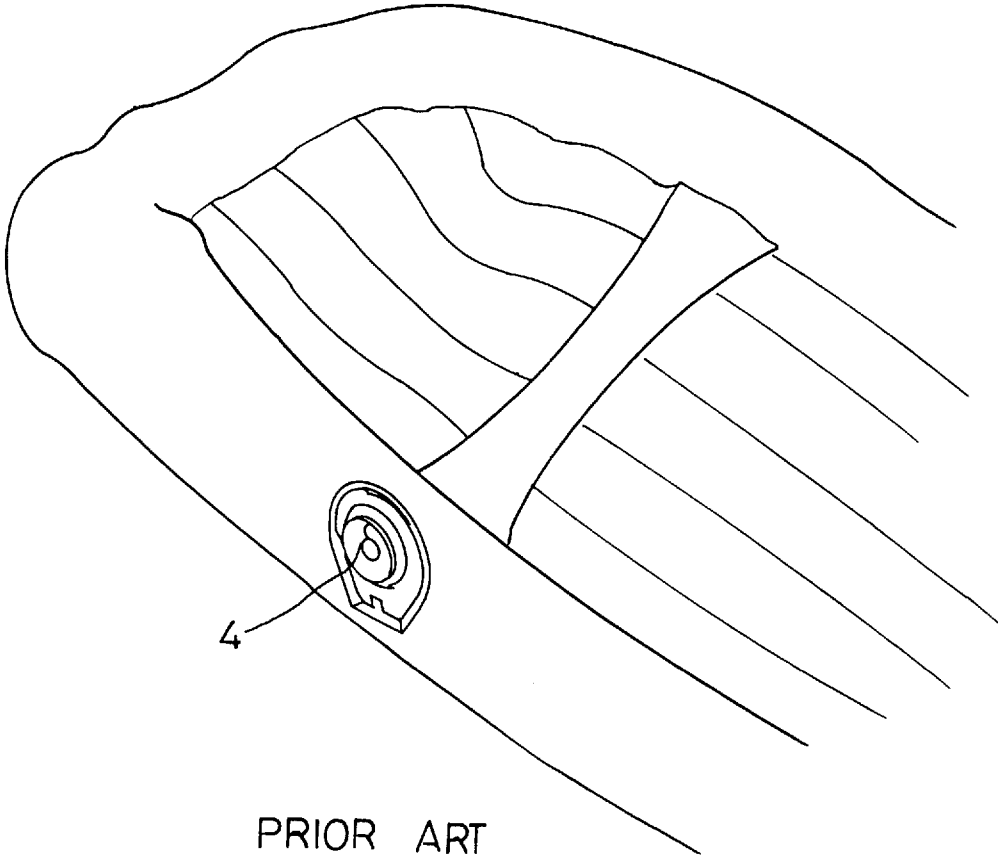
PRIOR ART FIG. 13
FIG. 13 illustrates a commonly seen inflatable article with a nozzle connector.
Figure 14:
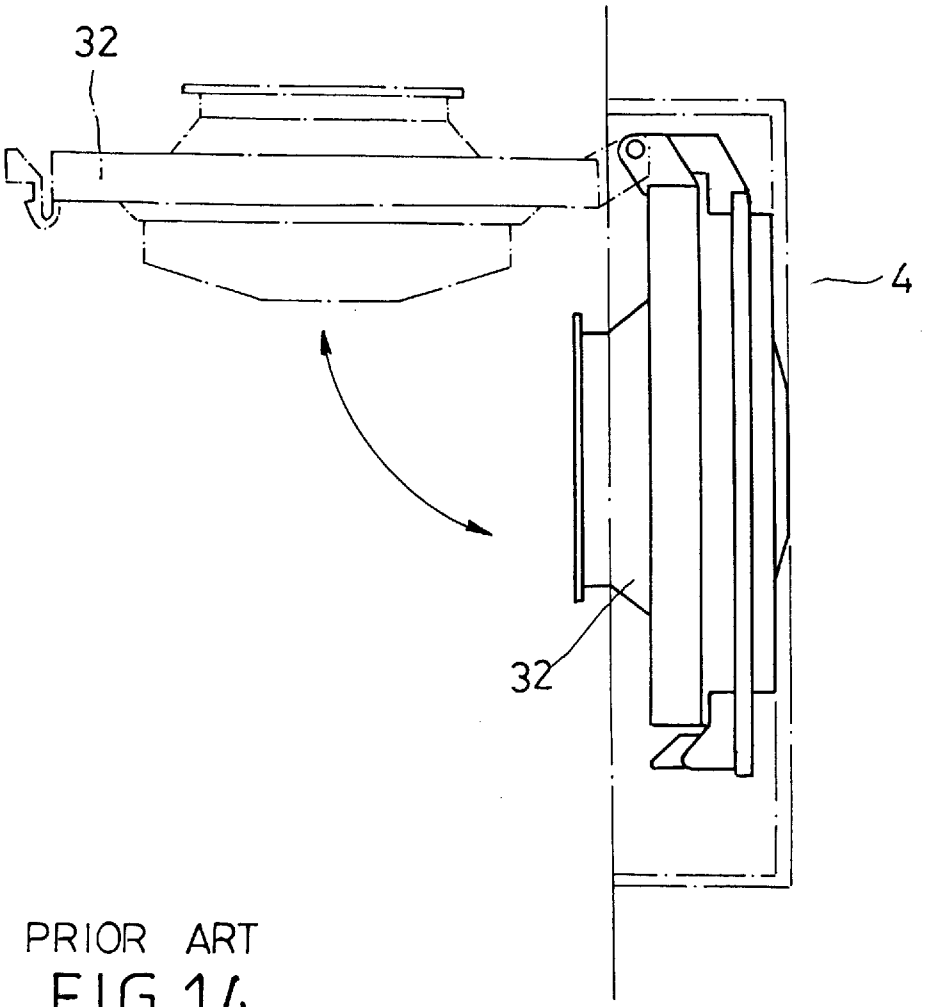
PRIOR ART FIG. 14
FIG. 14 illustrates how to open the nozzle connector shown in FIG. 13 to exhaust air.

The impeller assembly 8 includes a plurality of blades 26, a battery 27 fitted into the impeller assembly 8, a cover 33 covering the bottom of the impeller assembly 8, two microswitches 36 and an electrical circuit (see FIG. 10). The impeller assembly 8 is arranged within the case composed of the blowing and exhausting chambers 6 and 7. The arrangement of the impeller assembly 8 within the case may be of any conventional design well known to the art and is not considered a part of the invention. The micro-switches 36 are each installed close to the neck portions 10 and 11 so that when either of the neck portions 10 and 11 is connected with a nozzle connector 12 (see FIG. 4A) of an inflatable article (not shown), the corresponding micro-switch 36 will be triggered to turn on the impeller assembly 8.

Figure 9:
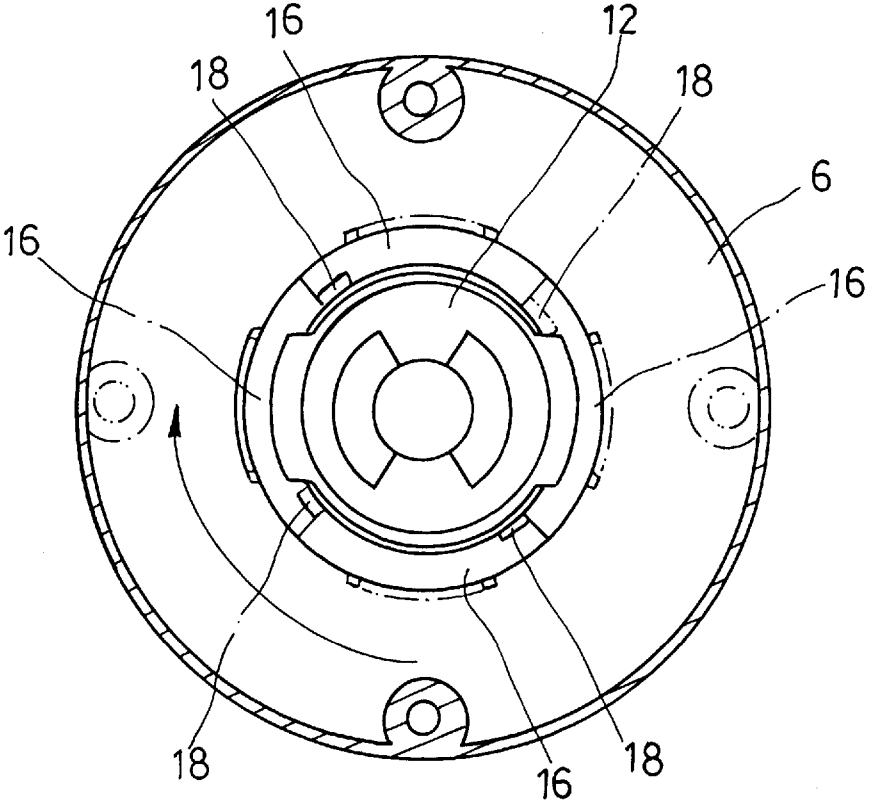
FIG. 9 illustrates the connection between the present invention and the nozzle connector of the inflatable article.

A power switch 15 is mounted between the two slots 13 and 14. An electrical socket 42 is fitted between the two notches 40 and 41. The connecting member 34 is circular in shape and has two coaxial holes with different diameters and two pairs of lugs 37 engageable with the lugs 16 of the blowing chamber 6 and the lugs 17 of the exhausting chamber 7. A strap 35 is used to connect the connecting member 34 with a protection formed by the hooks 28 and 29. The blowing hood 9 is a funnel-shaped member formed with two opposite lugs 38 at the large end engageable with lugs 16 of the blowing chamber 6. Similarly, the exhausting hood 91 is also a funnel-shaped member formed with two opposite lugs 381 at the large end engageable with the lugs 17 of the exhausting chamber 7. The connection between the neck portion of the blowing chamber 6 and the nozzle connector 12 (see FIG. 4A) of an inflatable article is shown in FIG. 9.

Figure 4:
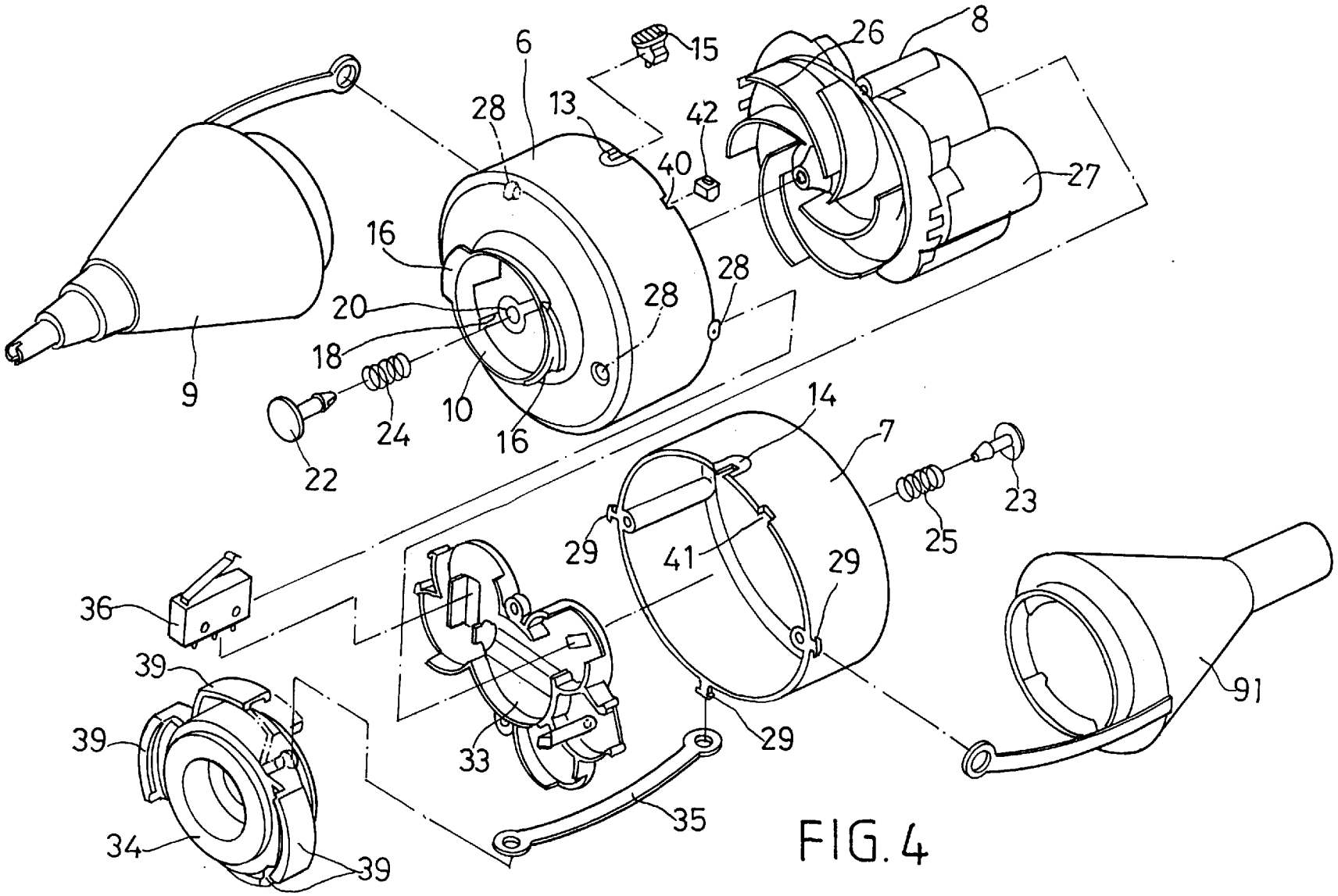
FIG. 4 is an exploded view of another preferred embodiment of the present invention.
Figure 4A:
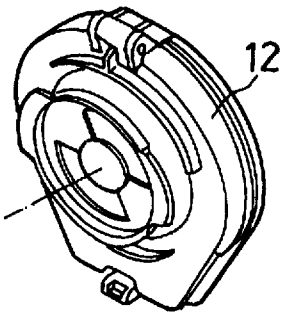
FIG. 4A is a perspective view of the nozzle connector.
Figure 6:
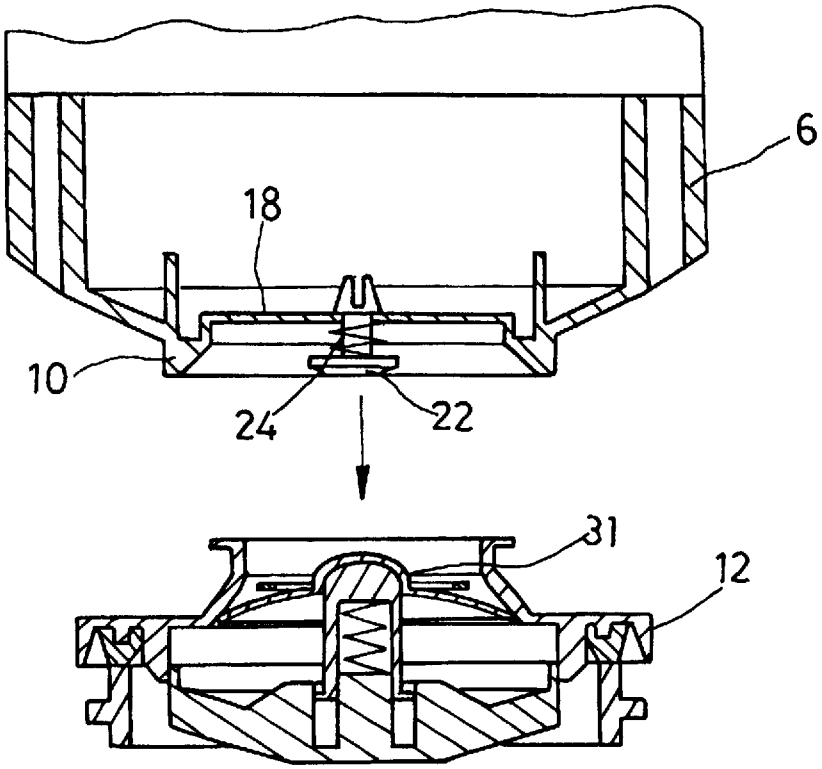
FIG. 6 illustrates how to engage the blowing chamber with the nozzle connector of an inflatable article.
Figure 6A:
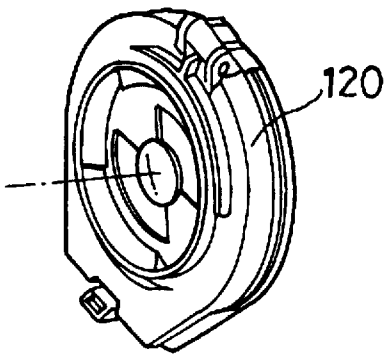
FIG. 6A is a perspective view of the nozzle connector shown in FIG. 6.
Figure 5:
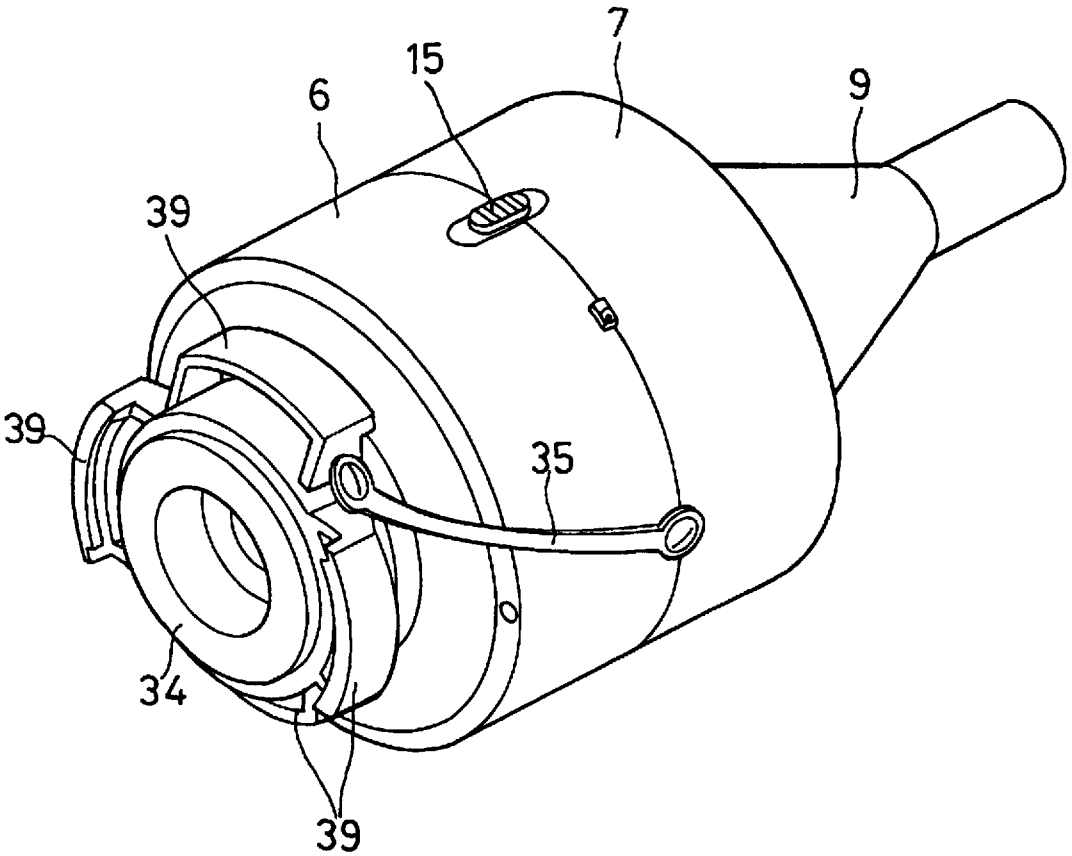
FIG. 5 is a perspective view of the present invention engaged with the connecting member.

The structures of the lugs 16 and 17 may be modified as shown in FIG. 4 so as to adapt to another type of connector 120 (see FIG. 6A) of an inflatable article. Further, the lugs 38 are provided at the inner side of the blowing nozzle 9 and exhausting nozzle 91 and the outer side of the connector 34 is provided with two pairs of seats 39 engageable with the blowing and exhaust chambers 6 and 7 (see FIG. 5).

Figure 7:
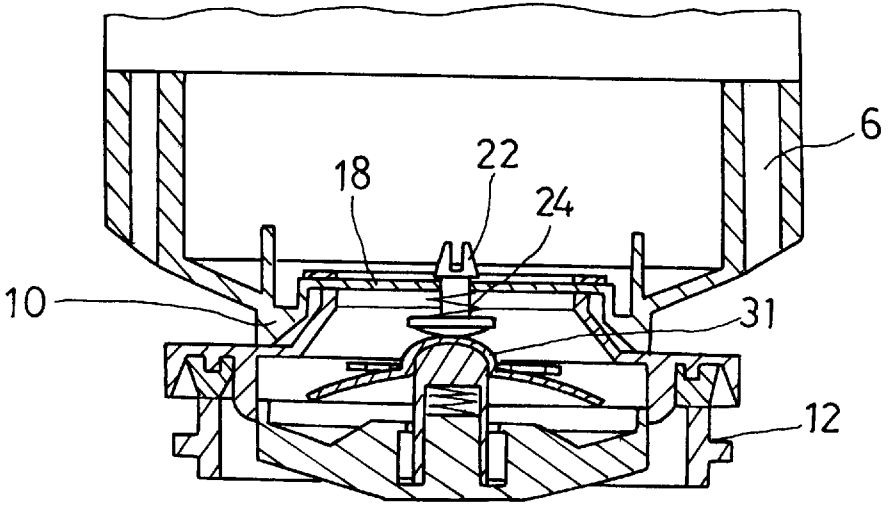
FIG. 7 illustrates how the present invention blows air into the inflatable article through the nozzle connector.
Figure 8:
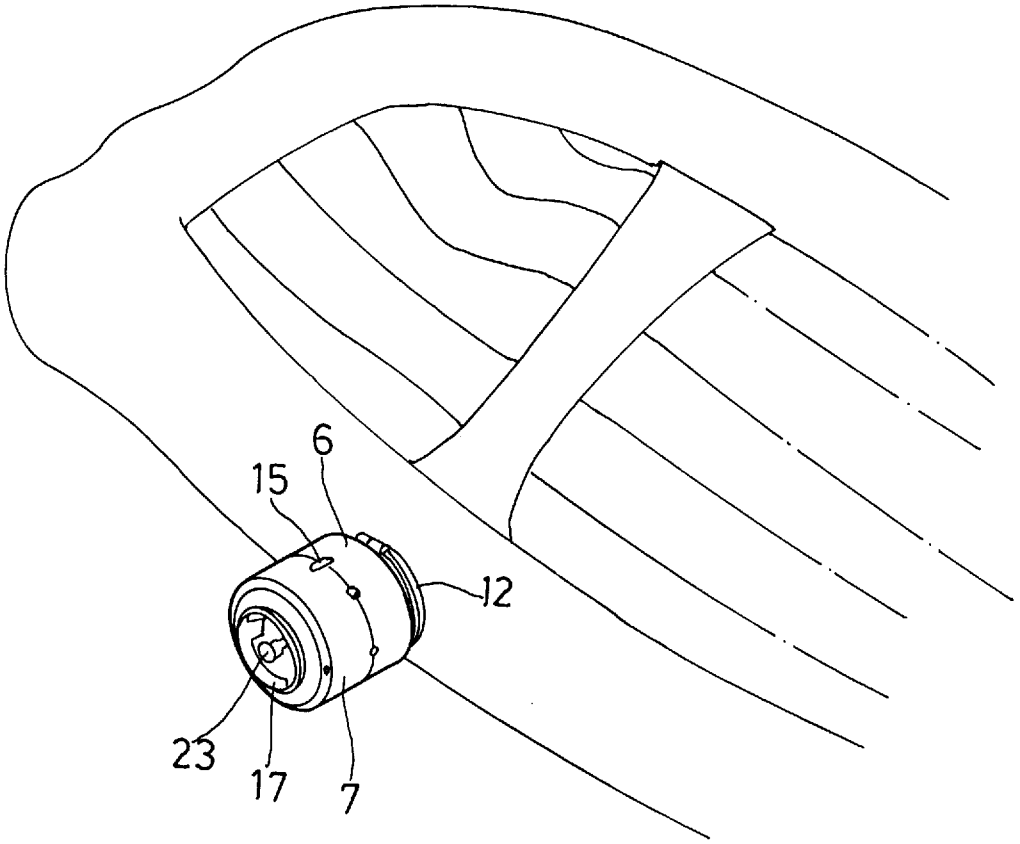
FIG. 8 is a working view of the present invention.

When desired to blow air into an article, simply connect the neck portion 10 of the blowing chamber 6 with the nozzle connector 12 of the inflatable article (see FIGS. 6, 7 and 8) so that the pin 22 will push open the check valve 31 of the nozzle connector 12 and the micro-switch 36 will be triggered to turned on the impeller assembly 8 to blow air into the inflatable article. The check valve 31 of the nozzle connetor 12 will be closed as soon as the neck portion 10 is disengaged therefrom. When desired to discharge air from an inflatable article, simply connect the neck portion 11 of the exhausting chamber 7 with the nozzle connector 12 so that the pin 23 will push open the check valve 31 of the nozzle connector 12 and the micro-switch 36 will be triggered to turn on the impeller assembly 8 to exhaust air out of the inflatable article.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A combinational air blower and exhauster comprising:

a cylindrical case including a cylindrial blowing chamber and a cylindrical exhausting chamber engaged with said cylindrical blowing chamber, said blower chamber having similar structure as said exhausting chamber, said blower chamber having an inner circumferential edge formed with a first slot, a first notch, and a plurality of first hooks, said exhausting chamber having an inner circumsferential edge formed with a second slot opposite to said first slot, a second notch aligned with said first notch, and a plurality of second hooks adapted to engage with said first hooks, said blower and exhausting chambers being respectively formed with first and second necks which are respectively formed with two first lugs and two second lugs, a first rib formed between said first lugs and having a first center hole, said second rib formed between said second lugs and having a second center hole, a first spring-loaded pin inserted in said first center hole, a second spring-loaded pin inserted in said second center hole;

an impeller assembly arranged within said casing and including a plurality of blades, a battery, a cover mounted on a bottom of said impeller assembly, two micro-switches each installed close to one of said neck portions, and an electrical circuit;

a power switch mounted between said slots;

an electrical socket fitted between said notches;

a circular connecting member having two coaxial holes with different diameters and two pairs of lugs engageable with said first and second lugs;

a strap connecting said circular connecting member to said hooks;

a funnel-shaped blowing hook having a large end formed with two opposite lugs engageable with said first lugs;

a funnel-shaped exhausting hood having a large end formed with two opposite lugs engageable with said second lugs.

* * * * *